US007306130B2

(12) United States Patent
Brugner

(10) Patent No.: US 7,306,130 B2
(45) Date of Patent: Dec. 11, 2007

(54) SEAL FOR A TWO-COMPONENT CARTRIDGE

(75) Inventor: Nikolaus Brugner, Ziemetshausen (DE)

(73) Assignee: Sulzer Chemtech AG, Winterthur (CH)

( * ) Notice: Subject to any disclaimer, the term of this patent is extended or adjusted under 35 U.S.C. 154(b) by 241 days.

(21) Appl. No.: 10/872,137

(22) Filed: Jun. 17, 2004

(65) Prior Publication Data

US 2005/0057637 A1 Mar. 17, 2005

(30) Foreign Application Priority Data

Jun. 27, 2003 (DE) ..... 203 09 931 U
Oct. 24, 2003 (EP) ..... 03024323

(51) Int. Cl.
*B65D 47/10* (2006.01)
*B65D 39/00* (2006.01)

(52) U.S. Cl. ..... 222/541.6; 215/254

(58) Field of Classification Search ..... 222/92, 222/94, 129, 138, 139, 145.1, 541.5, 541.6; 215/235, 237, 250, 253–254; 285/328
See application file for complete search history.

(56) References Cited

U.S. PATENT DOCUMENTS 3,289,887 A 12/1966 Farrar et al.
3,506,157 A * 4/1970 Dukess ..... 222/94
3,591,031 A 7/1971 Komendowski
3,667,638 A 6/1972 Cambio, Jr.
3,750,820 A 8/1973 Labarre
4,355,729 A * 10/1982 Maguire ..... 215/215
4,884,703 A * 12/1989 O'Meara ..... 215/6
5,301,842 A * 4/1994 Ritter ..... 222/137
5,328,056 A * 7/1994 Schneider et al. ..... 222/94
5,647,510 A * 7/1997 Keller ..... 222/94
5,676,280 A 10/1997 Robinson
5,785,209 A * 7/1998 Guglielmini ..... 222/153.07
6,484,904 B1 * 11/2002 Horner et al. ..... 222/137
6,634,524 B1 * 10/2003 Helmenstein ..... 222/94
6,685,041 B1 * 2/2004 Geisinger ..... 215/6
6,874,661 B2 * 4/2005 Timmerman et al. ..... 222/135

FOREIGN PATENT DOCUMENTS

DE 74 25 326 U 10/1974
DE 34 06 323 A1 3/1985
DE 3930595 A1 9/1989

(Continued)

*Primary Examiner*—Anh T. N. Vo
(74) *Attorney, Agent, or Firm*—Martin Fleit; Paul D. Bianco; Fleit Kain Gibbons Gutman Bongini & Bianco P.L.

(57) ABSTRACT

A cartridge, particularly a two-component or multi-component cartridge, with at least one cartridge neck and one outlet opening that is closed with a seal that is integrally connected to the cartridge neck, wherein this connection is sectionally realized at least in sections in the form of a predetermined break point, and wherein the cartridge can be opened by tearing off this connection. In order to allow a simple opening of the seal, it contains at least one cap that is integrally connected to the cartridge neck and at least one tear-off element that is integrally connected to the cap, wherein the connection between the cap and the cartridge neck can be torn off manually by exerting tensile force on the tear-off element.

18 Claims, 11 Drawing Sheets

FOREIGN PATENT DOCUMENTS

| | | | |
|---|---|---|---|
| DE | 29807938 | U1 | 5/1990 |
| DE | 4340553 | A1 | 11/1993 |
| DE | 19628552 | A1 | 7/1996 |
| DE | 198 09 255A01 | | 9/1999 |
| DE | 19943877 | A1 | 9/1999 |
| EP | 0730913 | A1 | 9/1996 |
| FR | 1 369260 | A | 8/1964 |
| WO | WO 98/08745 | A | 3/1998 |
| WO | WO 02/094681 | A | 11/2002 |
| WO | WO 02/094681 | A1 | 11/2002 |

* cited by examiner

SEAL FOR A TWO-COMPONENT CARTRIDGE

BACKGROUND OF THE INVENTION

1. Field of the Invention

The invention pertains to a cartridge, particularly a two-component or multi-component cartridge.

2. Prior Art

Two-component cartridges are used, in particular, for providing ready-to-use two-component adhesives. Such two-component cartridges are available in two variations, namely in the form of coaxial cartridges and in the form of side-by-side cartridges. Both variations must be provided with a seal in order to separately seal the respective components and to prevent the two components from leaking or reacting during storage or transport of the cartridges. In order to press out the components, the seal is removed and a static mixer is attached in order to make the two components react when they are pressed out.

Known seals of this type comprise a screw cap or a screw cap with an additional plug. Cartridges with such seals can be adequately and tightly sealed after use, but their manufacture is relatively expensive and an additional pre-assembly step is required.

Other seals, particularly for double syringes, are integrally injection-molded onto the cartridge, where the cartridge is opened by breaking off the seal. These seals have the disadvantage that the part to be broken off protrudes and consequently may be broken off just as easily as during transport or filling of the cartridge. In addition, if the contents of cartridge are not entire used up, the cartridge must be closed with another seal after its use.

A cartridge in which a seal is molded onto the cartridge body is known from WO 02/094681. The cartridge opening can be opened by breaking the seal off the cartridge body and can later be re-sealed. To open the seal, however, additional tools such as a screwdriver are necessary.

In light of the aforementioned prior art, the invention aims to develop a seal for two-component cartridges that can be directly manufactured together with the cartridge by means of an injection molding process such that an additional injection-molded part and an additional installation step are not required, where said seal can be easily manipulated when the cartridge is opened and provides superior protection against unintentional opening of the cartridge.

SUMMARY OF THE INVENTION

According to the invention, this objective is realized with a cartridge with the novel characteristics as described hereinafter. Advantageous additional developments are disclosed in the following description.

The cartridge according to the invention consequently contains at least one cartridge neck with an outlet opening that is closed with a seal that is integrally connected to the cartridge. The seal comprises at least one cap that is integrally connected to the cartridge neck and at least one tear-off element that is integrally connected to the cap. The outlet opening of the cartridge can be manually opened without auxiliary means by exerting a tensile force on the tear-off element. The tear-off element preferably consists of a tear-off ring or a tear-off strap that is connected to the cap by means of a flexible connection. In order to prevent the seal from being unintentionally torn from the cartridge neck, the cap is formed and arranged in such a way that it does not project very much beyond the upper end of the cartridge neck. The flexible connection between the tear-off element and the cap also contributes to preventing unintentional opening of the cartridge, for example, by tearing off the seal during transport or filling of the cartridge.

The seal includes a tear-off element that is directly injection-molded onto the cartridge body, particularly the cartridge neck, during manufacture of the cartridge. Although the cartridge neck may have a smaller diameter than the remaining cartridge body, it may also be realized identically to the remaining cartridge body in terms of shape and size.

The cartridge preferably consists of a two-component cartridge with two outlet openings. The seal is realized in such a way that both outlet openings of the cartridge can be tightly sealed with a single cap. Alternatively, it would also be conceivable to provide two caps, i.e., one cap for each outlet opening.

In one embodiment of the cartridge, the tear-off element consists of a tear-off ring that preferably does not significantly protrude beyond the cartridge end, including the cap, in the longitudinal direction of the cartridge. This prevents the seal from being unintentionally torn from the cartridge body.

The cartridge can be simply opened by pulling on the tear-off element with one hand. Thus, no auxiliary means is required for opening the cartridge. Once a certain force is exerted, the connection between the cap and the cartridge neck is torn along at least one predetermined break point, exposing the outlet openings. In the embodiment of a two-component cartridge, the seal is advantageously designed in such a way that both cartridge openings can be simultaneously exposed with a single tear-off ring. If the tear-off ring is arranged around the outlet openings on the neck of the cartridge, it can be advantageously connected to the cap, which seals the outlet openings at a second location. This ensures that the cap is reliably held on the cartridge and that the tear-off ring cannot accidentally become caught on an object.

In order to allow universal utilization of the cartridge for low-viscosity as well as high-viscosity components, it is possible to provide another predetermined break point in addition to the predetermined break point that can be torn off by means of the tear-off element, wherein the second predetermined break point is cut off with a cutting tool. The predetermined break point that can be torn off is intended for opening a cartridge filled with low-viscosity components, exposing outlet openings of smaller cross section. The predetermined break point that can be cut off exposes outlet openings of larger cross section as is required, for example, for high-viscosity components.

The concept according to the invention is suitable for cartridges with a single chamber, as well as for two-component or multi-component cartridges with two or more chambers. In two-component or multi-component cartridges, the outlet openings of the individual chambers may be arranged such that they lie coaxially or adjacent to one another.

BRIEF DESCRIPTION OF THE DRAWINGS

Embodiments of the invention are described below with reference to the figures. The figures show.

DETAILED DESCRIPTION OF PREFERRED EMBODIMENTS OF THE INVENTION

Figure 1:
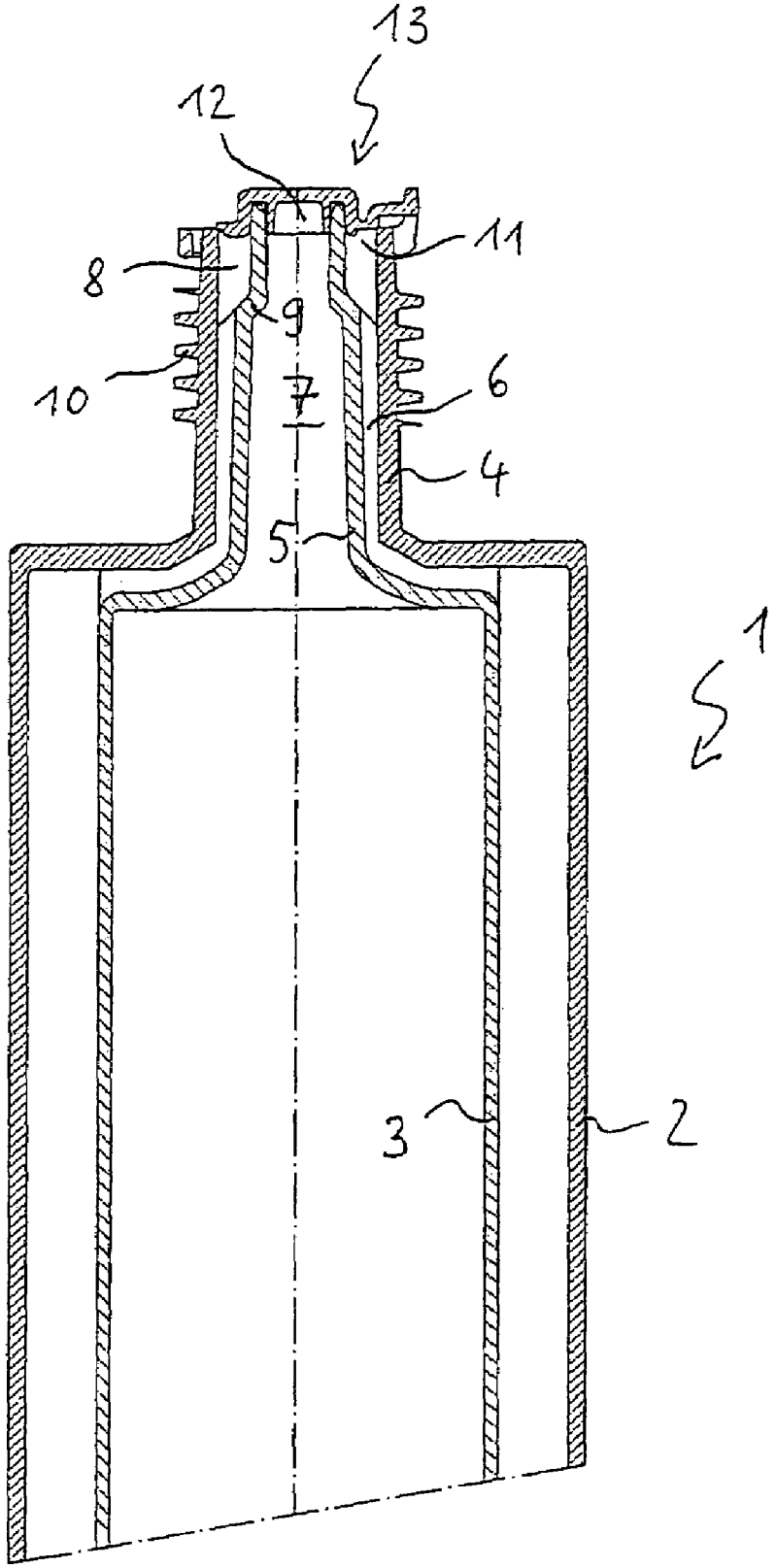
FIG. 1, a section through a coaxial cartridge with a coaxial outlet and with a tear-off ring seal according to the invention.

A first embodiment of the invention is illustrated in FIGS. 1-3. FIG. 1 shows a coaxial cartridge 1, in which two cartridge housings 2 and 3 of different diameter are arranged coaxially. In this case, the housing with the smaller diameter 3 is located within the housing with the larger diameter 2. This also applies to the necks 4 and 5 of the two housings 2 and 3. Thus, these necks define an outer outlet channel 6 of annular cross section and an inner outlet channel 7 of circular cross section. In the end region of the outer outlet channel 6, several projections 8 are distributed around the circumference of the outer neck 4. A shoulder 9 of the inner neck 5 is supported on these projections such that the position of the two housings 2 and 3 is defined in the axial direction. The outer neck 4 contains threads 10 for screwing on a (not-shown) static mixer. This construction of a coaxial cartridge 1 corresponds to the prior art.

The outlet channels 6 and 7 are closed with a seal 13 according to the invention on their ends, i.e., in the region of their respective outlet openings 11 and 12. This seal is described below with reference to the more detailed cross section and top view illustrated in FIGS. 2*a* and 2*b*, respectively. The seal 13 comprises a cap 14 and a tear-off ring 15 connected to the cap 14 by means of a connecting piece 16. On the inner edge of the outer outlet opening 11, the cap 14 is integrally connected to the outer neck 4 by means of an annular region that acts as a predetermined break point 17 with respect to the function of the seal 13, i.e., the cap is manufactured together with the outer housing 2 that makes a transition into this neck 4 by means of an injection molding process. This ensures a hermetic seal of both outlet channels 6 and 7 relative to the outside.

In order to prevent a premature reaction of the two components contained in the cartridge 1, the outlet channels 6 and 7 also must be mutually sealed. For this purpose, the underside of the cap 14 is shaped such that it forms an annular depression 18 that in the initial state is non-positively engaged with the upper edge of the inner neck 5 and tightly seals the outer outlet opening 11 relative to the inner outlet opening 12 in order to prevent the substances in the two outlet channels 6 and 7 from coming in contact with each another.

Figure 2A:
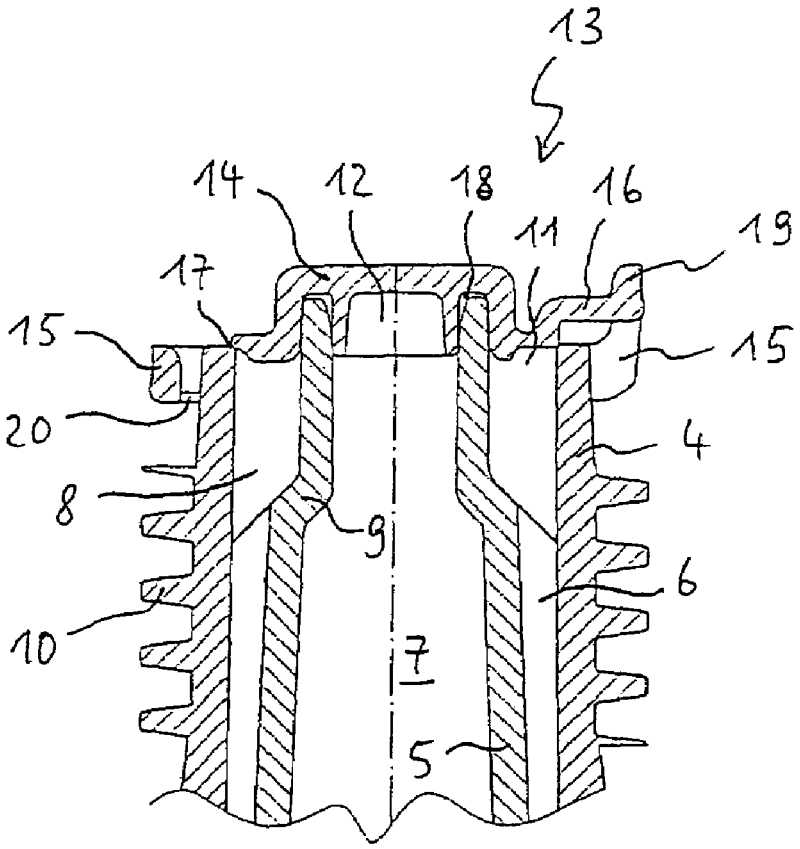
FIG. 2*a*, a detail of the outlet with the tear-off ring seal of the cartridge shown in FIG. 1.
Figure 2B:
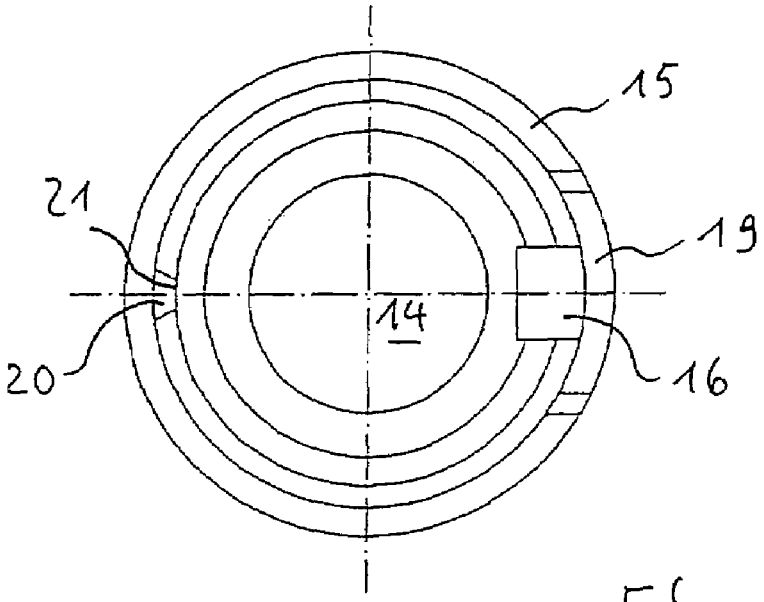
FIG. 2*b*, a top view of the outlet with the tear-off ring seal shown in FIG. 2*a;*

According to FIGS. 2*a* and 2*b*, the tear-off ring 15 approximately surrounds the outer neck 4 of the cartridge 1 at the level of the outlet openings 11 and 12. The center axis of the cartridge 1 simultaneously corresponds to the center axis of the ring 15. At the location 19 at which the piece 16 transitions into the tear-off ring 15, the connecting piece is slightly raised relative to its remaining circumference, but does not project beyond the upper side of the cap 14 in the longitudinal direction of the cartridge 1. The remaining circumference of the tear-off ring 15 lies at the level of the upper edge of the outer neck 4 with its upper edge. It is quite obvious that this shape and arrangement of the tear-off ring 15 does not increase the total length of the cartridge 1. Consequently, the risk that the tear-off ring 15 will accidentally get caught on an object during manipulation of the cartridge 1 is effectively reduced.

On the opposite side of the connecting piece 16, the tear-off ring 15 is connected to the outer neck 4 of the cartridge 1 by means of an additional connecting piece 20. The connecting piece 20 tapers toward the neck 4 such that a predetermined break point 21 is formed at its transition into the neck 4. The connecting piece 20 serves to stabilize the tear-off ring 15 in a plane that lies perpendicular to the center axis of the cartridge 1. Thus, the tear-off ring 15 is also prevented from becoming unintentionally bent and protruding upward over the cap 14 in the bent state.

Figure 3A:
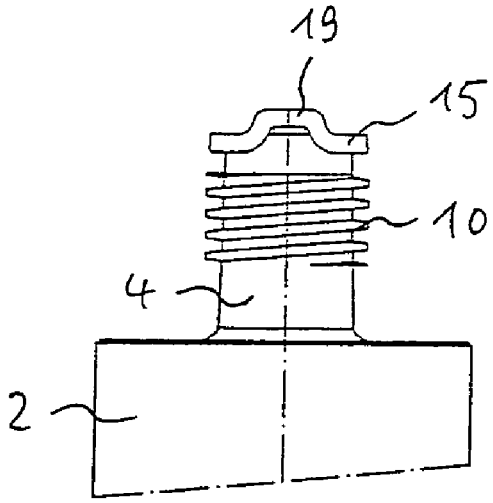
FIG. 3*a*, an outside view of the upper region of the cartridge shown in FIG. 1.
Figure 3B:
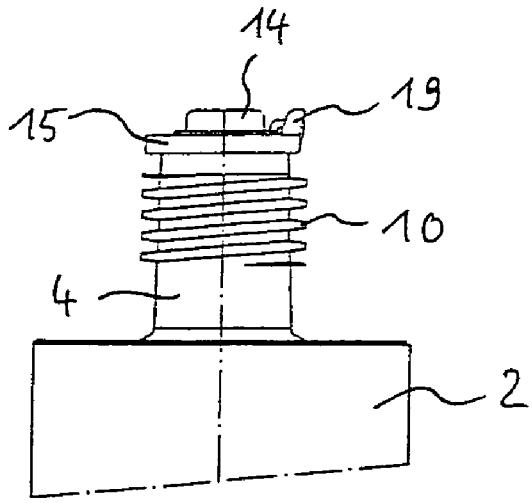
FIG. 3*b*, another outside view of the upper region of the cartridge shown in FIG. 1 which is turned 90° relative to FIG. 3*a;*
Figure 3C:
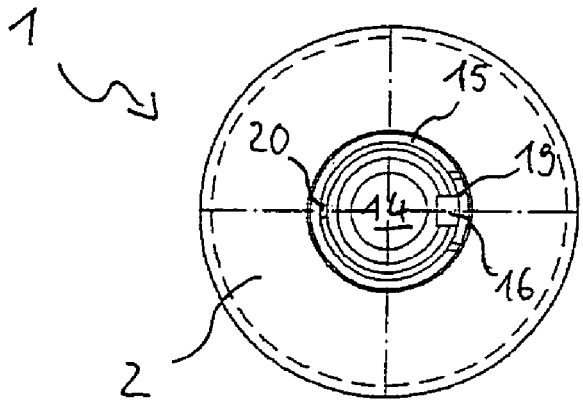
FIG. 3*c*, a top view of the cartridge region shown in FIG. 3*b;*

FIGS. 3*a*-3*c* show the upper region of the cartridge 1 in the form of two side views that are turned relative to one another by 90° and a top view. Recognizable details are designated by the same reference symbols as in FIGS. 1, 2*a* and 2*b*. FIGS. 3*a* and 3*b* very well elucidate the space-saving size of the seal 13 in relation to the dimensions of the outer neck 4 of the cartridge 1.

The tear-off ring 15 serves for initial manual tearing of the thin predetermined break point 21 between the tear-off ring and the outer neck 4 in order to open the cap 14. This can be achieved with little effort. Subsequently, the tear-off ring 15 can be bent upward about an axis that extends approximately tangential to the tear-off ring 15 in the region of the wider connecting piece 16 and securing grasped with one or more fingers of one hand in order to exert a higher, upwardly directed tensile force on the tear-off ring. In this case, the diameter of the tear-off ring 15 can be chosen such that a finger can be inserted. In this case, a force can be exerted upon the tear-off ring in particularly simple fashion, and it is no longer possible for the fingers to slip off the ring.

The tensile force exerted on the tear-off ring is transmitted onto the cap 14 by means of the connecting piece 16 and causes the ring to be torn from the outer neck 4 of the cartridge 1 along the predetermined break point 17. This tearing-off starts adjacent to the transition of the connecting piece 16 into the cap 14 and continues along two semicircular regions until the opposite region of the predetermined break point 17 that was originally located adjacent to the connecting piece 20 is reached and the cap 14 is completely separated from the neck 4. The non-positive connection between the cap 14 and the upper end of the inner neck 5 is simultaneously released such that both outlet openings 11 and 12 are exposed. A static mixer can be then screwed onto the neck 4 with the aid of the threads 10.

Figure 4A:
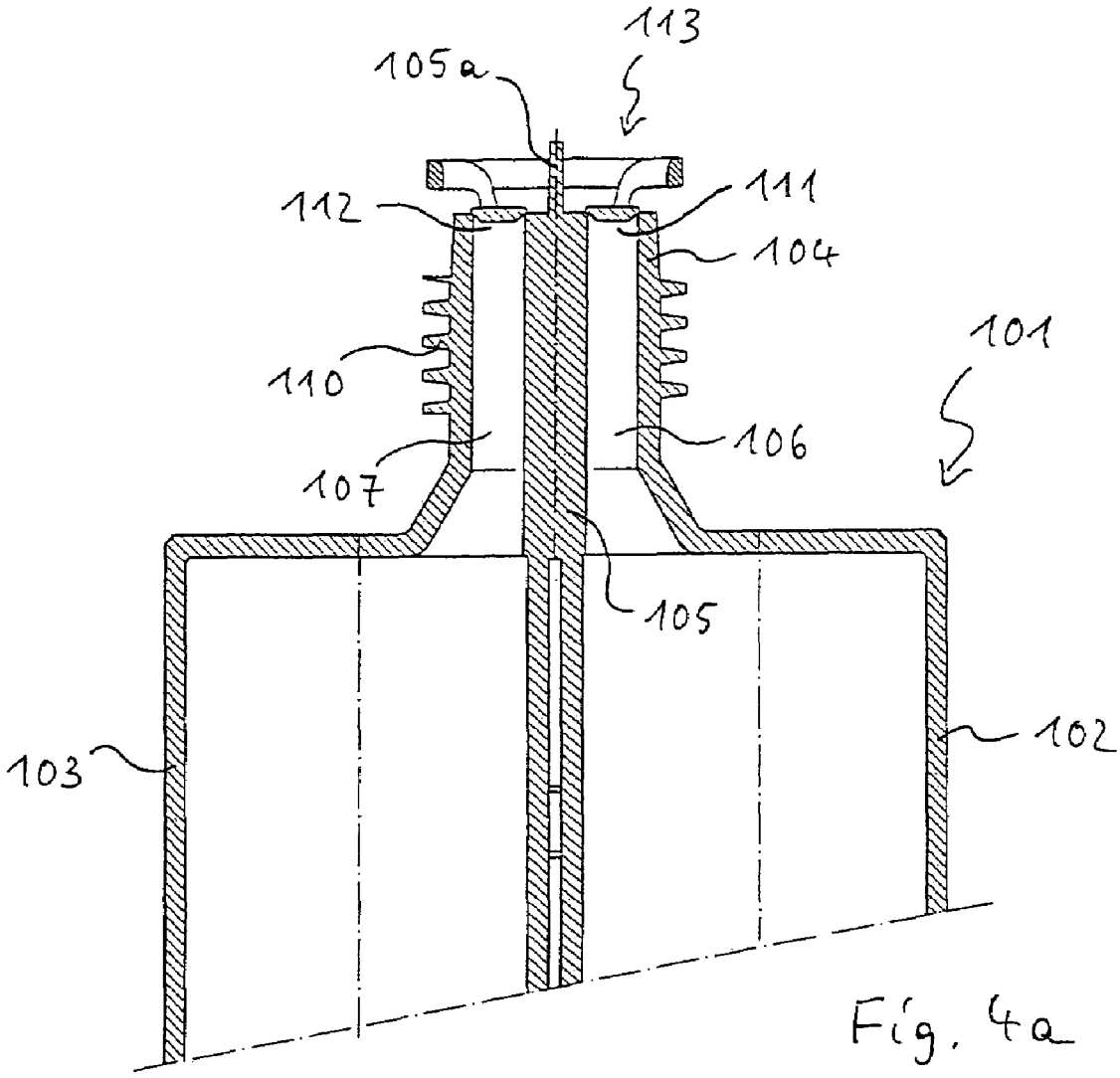
FIG. 4*a*, a section through a side-by-side cartridge with side-by-side outlets and a tear-off ring seal according to the invention.
Figure 4B:
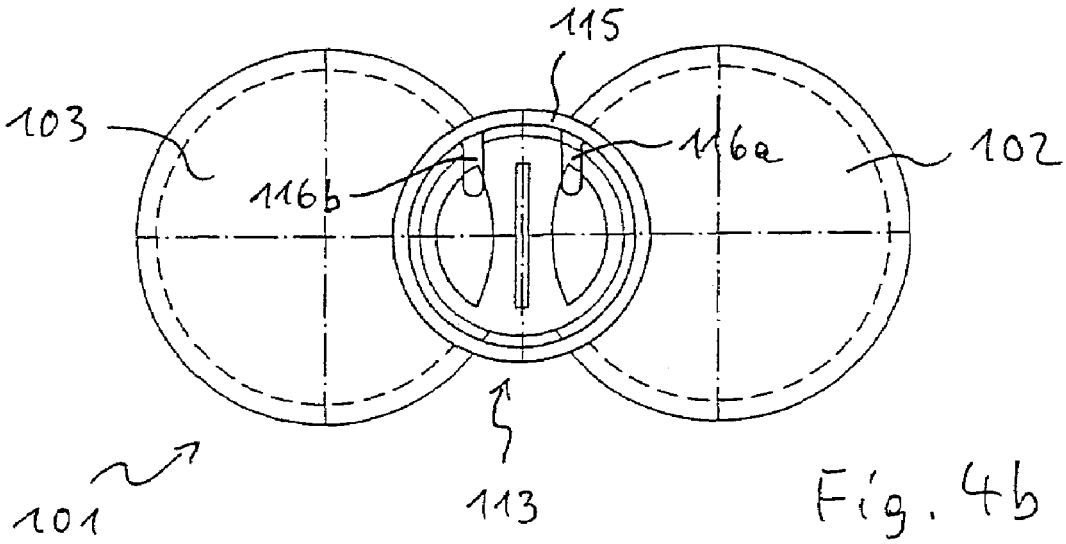
FIG. 4*b*, a top view of the cartridge shown in FIG. 4*a;*
Figure 5:
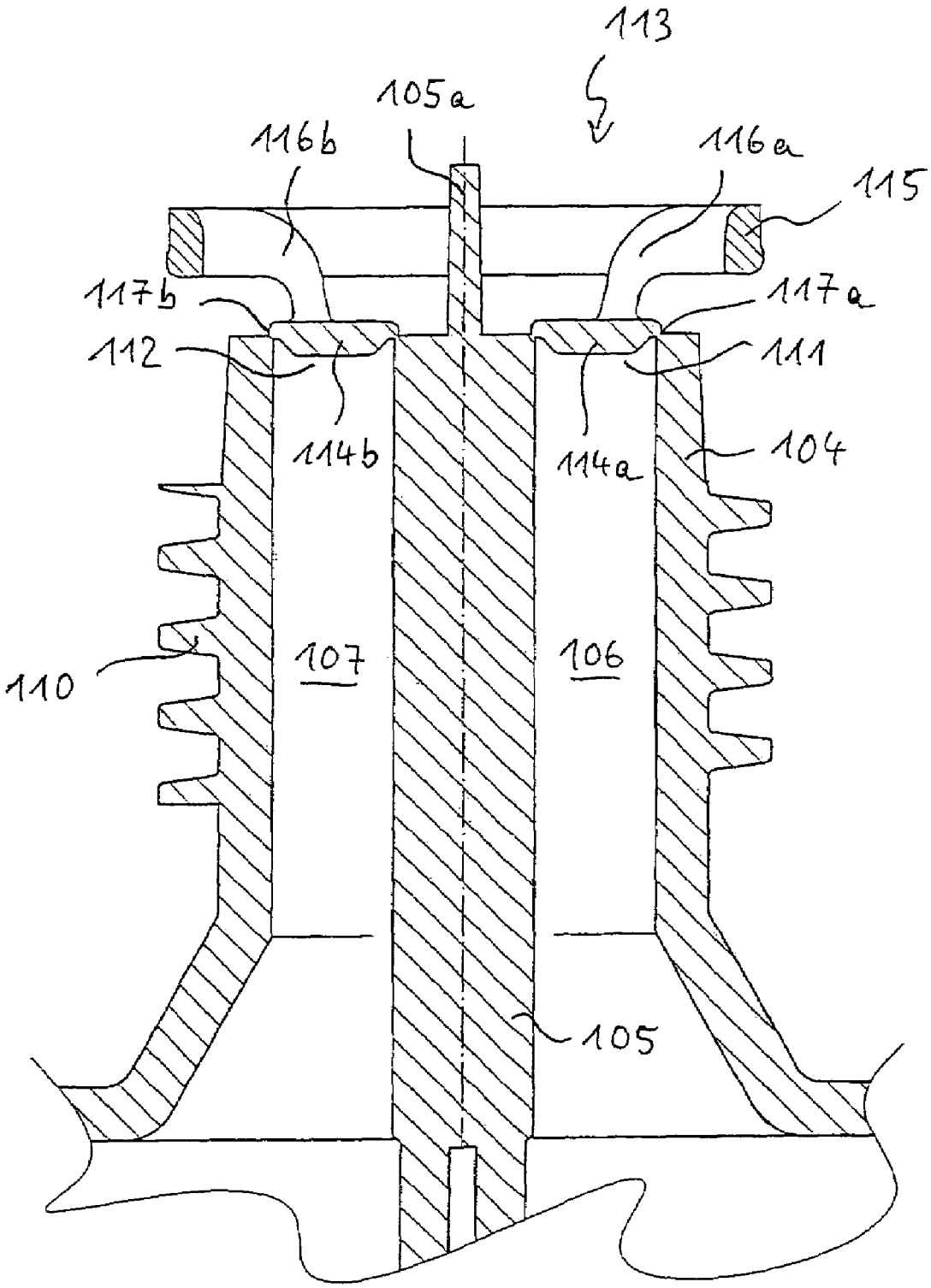
FIG. 5, a detail of the outlet with the tear-off ring seal shown in FIG. 4*a;*

Another embodiment of the invention that pertains to a two-component cartridge with adjacent outlet channels for the two components is described below with reference to FIGS. 4 and 5. FIG. 4*a* shows a cross-sectional representation of the upper region of such a cartridge 101, FIG. 4*b* shows a top view of this cartridge, and FIG. 5 shows a detailed cross section through the neck 104 of the cartridge 101.

According to FIG. 4*a*, the cartridge 101 consists of two housings 102 and 103 that are arranged parallel and adjacent to one another ("side-by-side") in this case. Consequently, the neck 104 contains two outlet channels 106 and 107 that lie parallel and adjacent to one another, wherein a partition wall 105 is located between the two outlet channels. The neck 104 is also provided with threads 110 for screwing on a static mixer in this case. An extension 105*a* protrudes from the upper end of the partition wall 105. This construction of a so-called side-by-side cartridge 101 corresponds to the prior art.

According to the invention, the ends of the outlet channels 106 and 107 are closed with a seal 113, i.e., in the region of their respective outlet openings 111 and 112. This seal is described below with reference to the detailed cross section shown in FIG. 5. The seal 113 comprises two caps 114*a* and 114*b*, as well as a tear-off ring 115 that is respectively connected to the caps 114*a* and 114*b* by means of connecting pieces 116*a* and 116*b* (see FIG. 4*b*). On the inner edges of the outlet openings 111 and 112, the caps 114*a* and 114*b* are respectively integrally connected to the neck 104 and the partition wall 105 by means of regions that act as predetermined break points 117*a* and 117*b* with respect to the function of the seal 113. According to FIG. 4*b*, the shape of the predetermined break points 117*a* and 117*b* is defined by the intersecting lines between the inside cross sections of the housings 102 and 103 and the inside cross section of the neck 104, i.e., it is respectively composed of two arcs of circles of different diameter.

The caps 114*a* and 114*b* are manufactured together with the housings 102 and 103 that transition into the neck 104 and the partition wall 105 by means of an injection molding process. This already ensures a hermetic seal of both outlet channels 106 and 107 relative to the outside, as well as relative to each other. Consequently, the components contained in the cartridge 101 cannot react prematurely.

It can be seen from FIGS. 4*a* and 4*b* that the tear-off ring 115 has an inside diameter that approximately corresponds to the outside diameter of the neck 104, wherein the tear-off ring is arranged coaxially to the neck 104 slightly above the outlet openings 111 and 112. Here, the connecting pieces 116*a* and 116*b* and the tear-off ring 115 may also be shaped such that the tear-off ring 115 surrounds the neck 104 in the same way in which the tear-off ring 15 surrounds the neck 4 of the first embodiment shown in FIGS. 1-3. This results in a more complex shape, but does not provide any advantages to the cartridge 101 because its maximum length is defined by the extension 105*a* of the partition wall 105. For reasons of simplicity, the connecting pieces 116*a* and 116*b* initially extend upward from the caps 114*a* and 114*b* and then laterally into the plane of the tear-off ring 115 in arc-shaped fashion. Although the tear-off ring is located slightly above the caps 114*a* and 114*b* in the second embodiment according to FIGS. 4 and 5, this is not important because it does not increase the total length of the cartridge 101. Consequently, the risk that the tear-off ring 115 will accidentally become caught on an object during manipulation of the cartridge 101 is also negligible in this embodiment.

Since in any case, the two connecting pieces 116*a* and 116*b* must be separated by a certain distance, the tear-off ring 115 is already better stabilized than the tear-off ring 15 by the connecting piece 16 in the first embodiment. Thus, an additional, opposing connecting piece for producing a connection with the neck 104 is not as useful in the second embodiment as in the first. Consequently, such an additional connecting piece is not shown in FIGS. 4 and 5, but could conceivably be provided in any case for security reasons.

The function of the tear-off ring 115 essentially corresponds to that of the tear-off ring 15 described above with reference to the first embodiment. If no additional connecting piece to the neck 104 is provided in accordance with FIGS. 4 and 5, the seal 113 is opened by initially bending the tear-off ring 115 upward about an axis that approximately extends through the transitions from the connecting pieces 116*a* and 116*b* into the tear-off ring 115. The tear-off ring 115 can then be securely grasped by one or more fingers of one hand in order to exert an upwardly directed tensile force. The diameter of the tear-off ring 115 may be chosen such that a finger can be inserted. Here, the force can be exerted in a particularly simple fashion and the fingers can no longer slip off the ring.

The tensile force acting on the tear-off ring is transmitted to the caps 114*a* and 114*b* by means of the connecting pieces 116*a* and 116*b* and results in the tear-off ring being torn from the neck 104 and from the partition wall 105 of the cartridge 101 along the predetermined break points 117*a* and 117*b*, respectively. This tearing-off begins adjacent to the respective transitions of the connecting pieces 116*a* and 116*b* into the caps 114*a* and 114*b* and continues to the opposite end of the predetermined break points 117*a* and 117*b*, respectively, until the caps 114*a* and 114*b* are completely separated from the neck 104 and from the partition wall 105 and both outlet openings 111 and 112 are exposed. A static mixer can then be screwed onto the neck 104 with the aid of the threads 110.

The two caps 114*a* and 114*b* are still held together by the tear-off ring 115 after they are separated from the cartridge 101. Thus, the hardware to be removed when using the cartridge 101 is kept to a minimum.

Figure 6A:
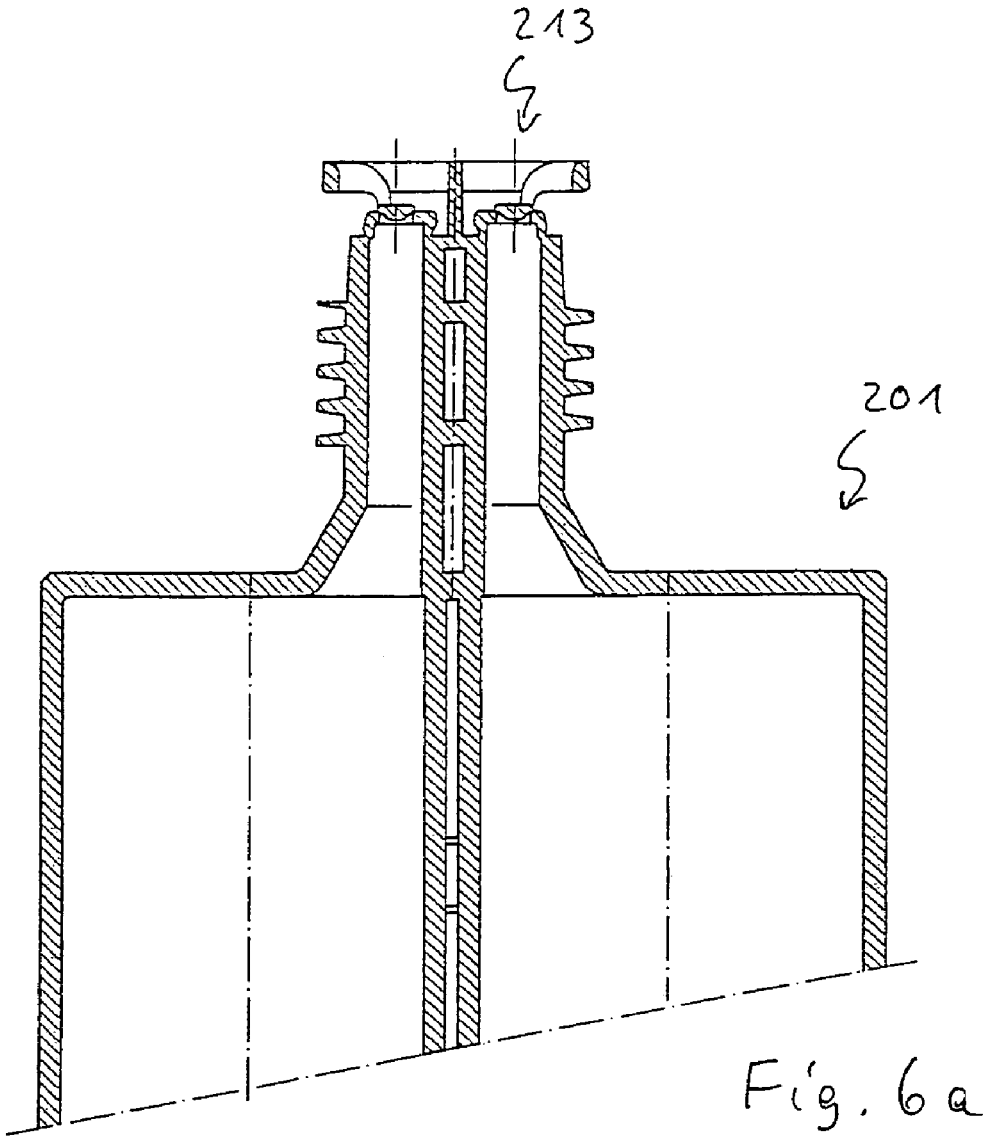
FIG. 6*a*, a variant of the cartridge shown in FIG. 4 with a small outlet opening for low-viscosity components and an option for additionally cutting off the outlet for high-viscosity components.
Figure 6B:
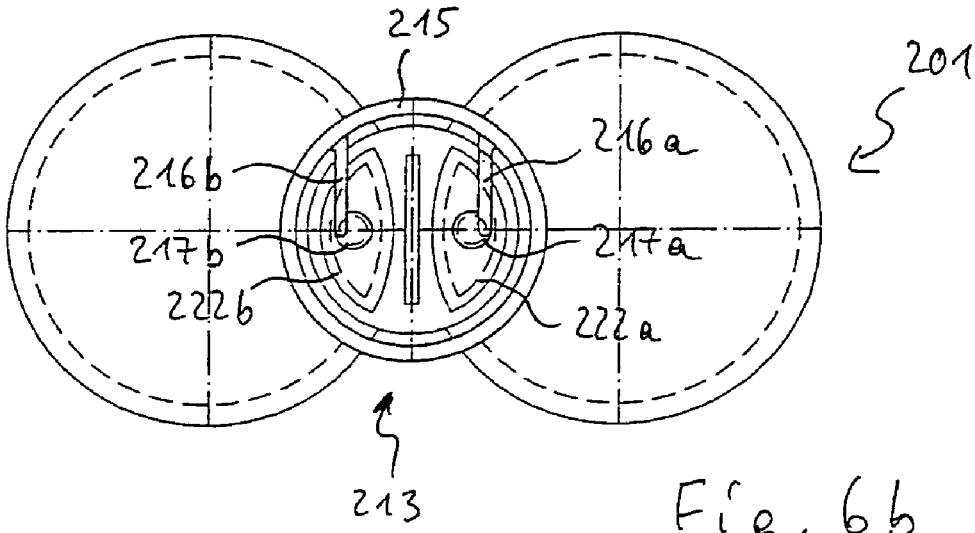
FIG. 6*b*, a top view of the cartridge shown in FIG. 6*a;*

A third embodiment of the invention that pertains to a variant of the above-described second embodiment is discussed below with reference to FIGS. 6 and 7. FIG. 6*a* shows a cross-sectional representation of the upper region of a side-by-side cartridge 201; FIG. 6*b* shows a top view of this cartridge, and FIG. 7 shows a detailed cross section through the neck 204 of the cartridge 201.

The third embodiment differs from the second embodiment merely in that the transitions from the caps 214*a* and

214*b* into the neck 204 and the partition wall 205 of the cartridge 201 respectively contain second predetermined break points 222*a* and 222*b* in addition to the first predetermined break points 217*a* and 217*b* that functionally correspond to the predetermined break points 117*a* and 117*b* in the second embodiment. With respect to the basic form and the integral design of the cartridge housings 202 and 203, the cartridge neck 204, the partition wall 205, as well as the seal 213 that comprises two caps 214*a* and 214*b*, a tear-off ring 215 and two pieces 216*a* and 216*b*, this embodiment corresponds to the previously described second embodiment.

Figure 7:
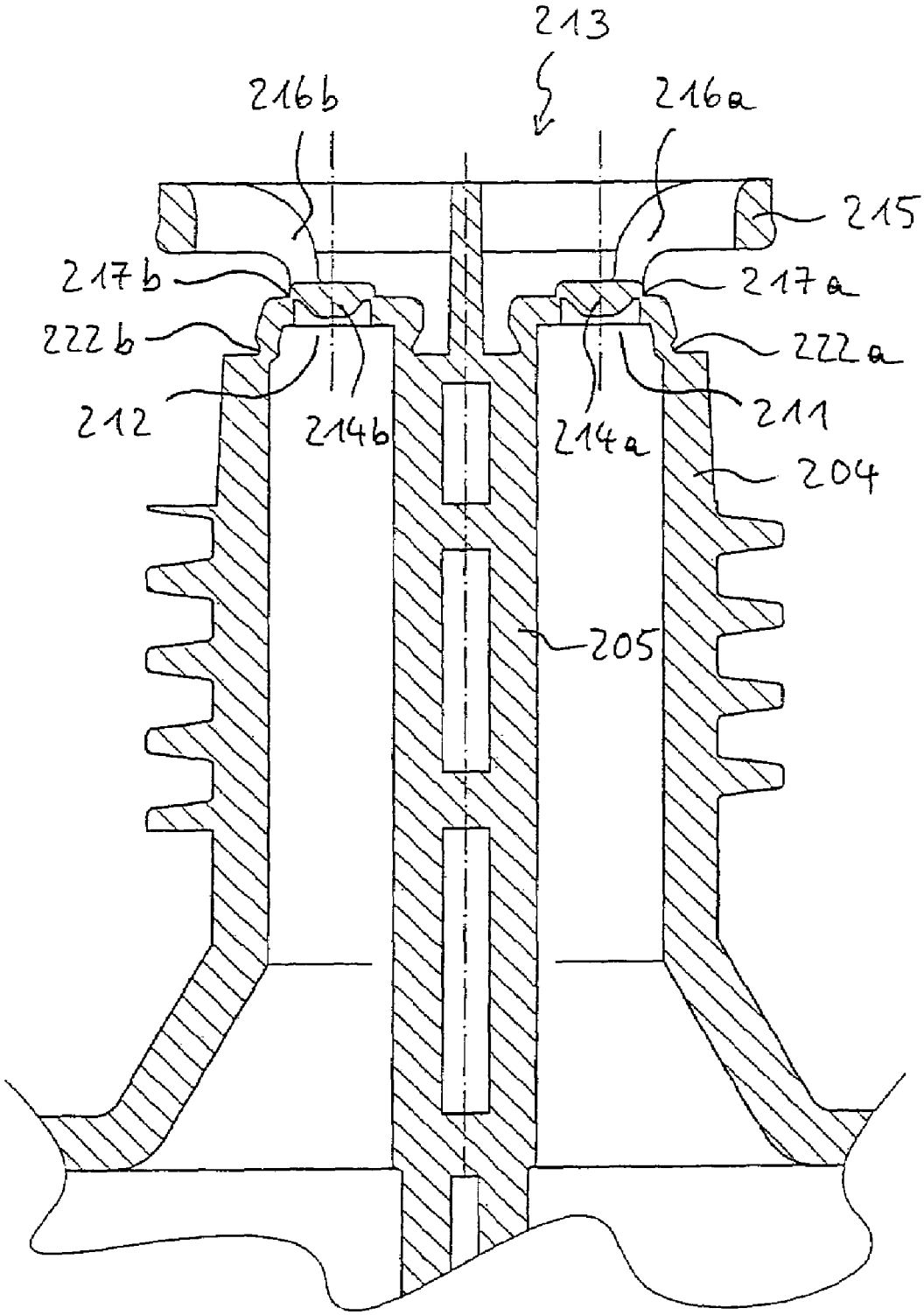
FIG. 7, a detail of the outlet with the tear-off ring seal of the cartridge shown in FIG. 6*a;*

The detailed representation according to FIG. 7 clearly indicates that the second predetermined break points 222*a* and 222*b* are respectively located between the first predetermined break points 217*a* and 217*b* and the neck 204. The cross section of the outlet openings 211 and 212 after tearing off the second predetermined break points 217*a* and 217*b* is larger than the cross section resulting from tearing off the first predetermined break points 217*a* and 217*b*. In addition, the material thickness is greater in the region of the second predetermined break points 222*a* and 222*b* than in the region of the first predetermined break points 217*a* and 217*b*.

The tear-off ring 215 is respectively connected to the caps 214*a* and 214*b* at locations that are completely surrounded by the first predetermined break points 217*a* and 217*b*, respectively. Therefore, a tensile force exerted on the tear-off ring 215 is introduced into the first predetermined break points 217*a* and 217*b* as well as into the second predetermined break points 222*a* and 222*b*. The first predetermined break points 217*a* and 217*b* are thus torn off first due to the comparatively smaller material thickness in this region, which makes it possible to expose outlet openings 211 and 212 with a first predetermined cross section by means of the tear-off ring 215. This first cross section is used when the cartridge 201 is filled with relatively low-viscosity components. In this case, the cross section of the outlet openings 211 and 212 must be correspondingly small in order to prevent the components from leaking uncontrollably.

The additional predetermined break points 222*a* and 222*b* are provided to make the cartridge 201 suitable for filling with highly viscous components that require a correspondingly large cross-section of the outlet openings 211 and 212 in order to press out the components from the cartridge 210 with a conventional pressure. Since the predetermined break points 222*a* and 222*b* are not torn off by means of the tear-off ring 215 as described above, they must be cut off with a cutting tool. However, this is relatively simple because the position for attaching the cutting tool is indicated on the outside by the shape of the predetermined break points 222*a* and 222*b*. This shape in the form of a peripheral notch also holds the blade of the cutting tool in the correct position and effectively prevents the cutting tool from slipping off while the additional predetermined break points are cut.

FIG. 6*b* very clearly shows that the shape of the second predetermined break points 222*a* and 222*b* in the third embodiment corresponds to that of the sole predetermined break points 117*a* and 117*b* in the second embodiment. However, the first predetermined break points 217*a* and 217*b* in the third embodiment which functionally correspond to the sole predetermined break points 117*a* and 117*b* in the second embodiment have significantly smaller lateral dimensions in comparison with them, in order to produce outlet openings 211 and 212 with a significantly smaller circular cross section in the embodiment shown. Since the structural features primarily correspond to those of the second embodiment, another explanation of the third embodiment would be redundant.

A fourth embodiment of the invention is illustrated in FIGS. 8 and 9. With respect to its structure and function, this embodiment largely corresponds to the embodiment shown in FIGS. 1-3. In comparison with this first embodiment, the only difference is that the upper side of the cap 314 is not realized in a largely planar fashion, but rather is designed such that the cap 314 can be used after having been turned 180° for reclosing the cartridge 301 if its contents have not been entirely used up.

For this purpose, the radially central region of the cap 314 that causes the mutual seal between the outlet channels 306 and 307 in the sealed original state of the cartridge 301 is realized in mirror-inverted fashion relative to its underside on the upper side that faces away from the cartridge 301 in the original state. However, the radial section 323 of the cap 314 that is located adjacent to the transition into the outer neck 304 in the form of the predetermined break point 317 is not realized in mirror-inverted fashion because a seal relative to the outside other than an integral connection must be produced when the turned cap 314 is attached.

This seal relative to the outside is achieved with a radially outer edge section 324 of the upper side of the cap 314 which extends upward in the shape of a cup. Here, its vertical, essentially cylindrical outer side contains a radial shoulder 325, where its outside diameter is slightly and abruptly reduced. The reduced outside diameter of the free end section 326 of the edge section 324 is larger than at least the inside diameter of the outer neck 304 of the cartridge 301. The vertical position of the shoulder 325 approximately corresponds to the height of the sealing elements provided in the radial center part of the upper side of the cap 314. These sealing elements represent a mirror image of the sealing elements provided in the center part of the underside of the cap.

Figure 8A:
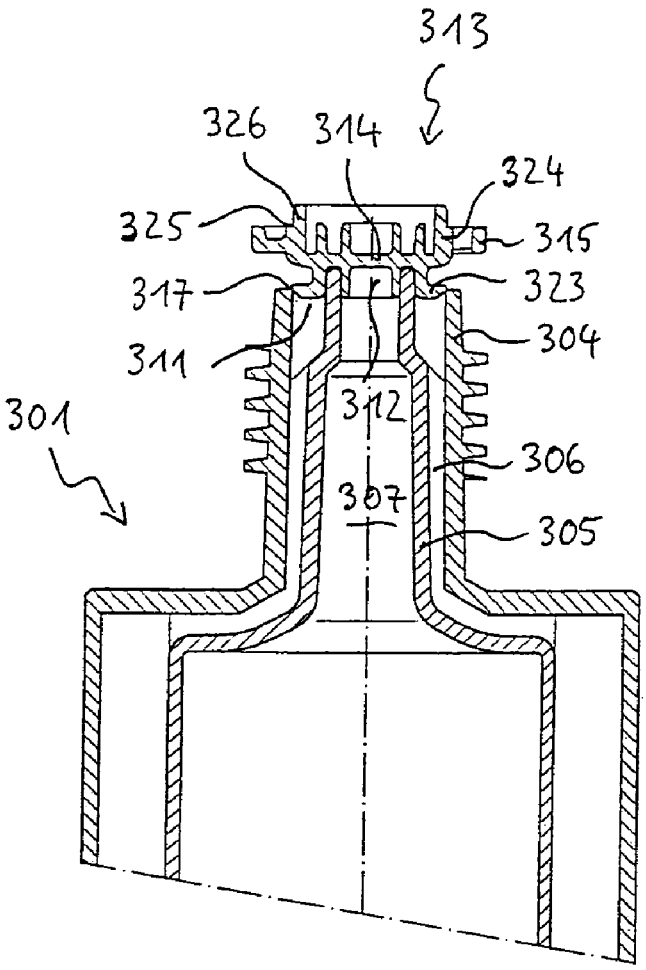
FIG. 8*a*, a section through a coaxial cartridge with a coaxial outlet and a reclosable tear-off ring seal according to the invention in the unopened state.
Figure 8C:
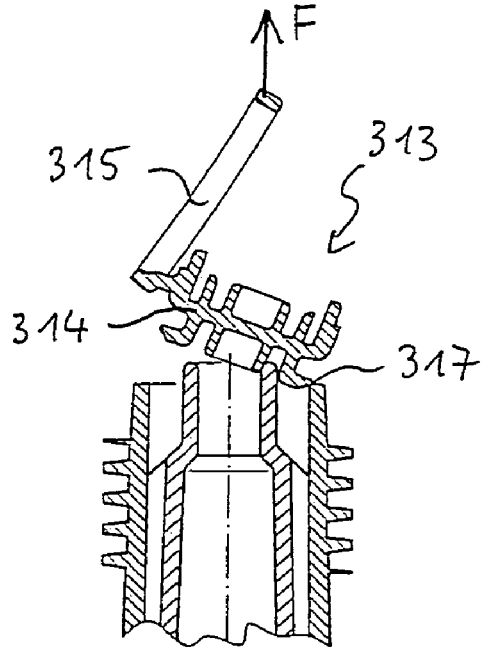
FIG. 8*c*, a detail of the section shown in FIG. 8*a* during the opening of the seal.
Figure 8B:
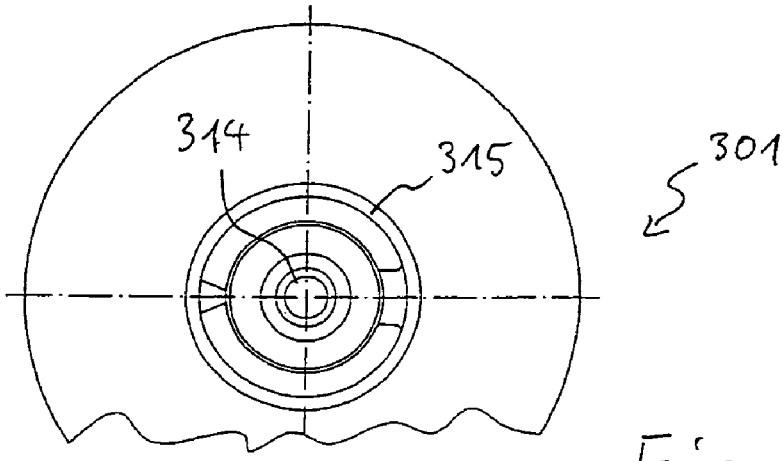
FIG. 8*b*, a top view of the cartridge shown in FIG. 8*a;*

FIGS. 8*a* and 8*b* show a coaxial variant of a two-component cartridge with a seal according to a fourth embodiment of the invention in the sealed original state, i.e., in the form of a partial cross section and a partial top view, respectively. Components that correspond to the previously discussed first embodiment are no longer identified separately in these figures. FIG. 8*c* shows the opening of the seal 313. The tear-off ring 315 is bent upward by exerting an upwardly directed tensile force upon the tear-off ring, as indicated with the arrow F in FIG. 8*c*, and the cap 314 is removed from the side, where it is connected to the tear-of ring 315, when the predetermined break point 317 is torn off. This tearing-off has already occurred on the left side in FIG. 8*c*. The tearing-off process shown in FIG. 8*c* also applies in its entirety to the first embodiment of the invention shown in FIGS. 1-3.

Figure 9A:
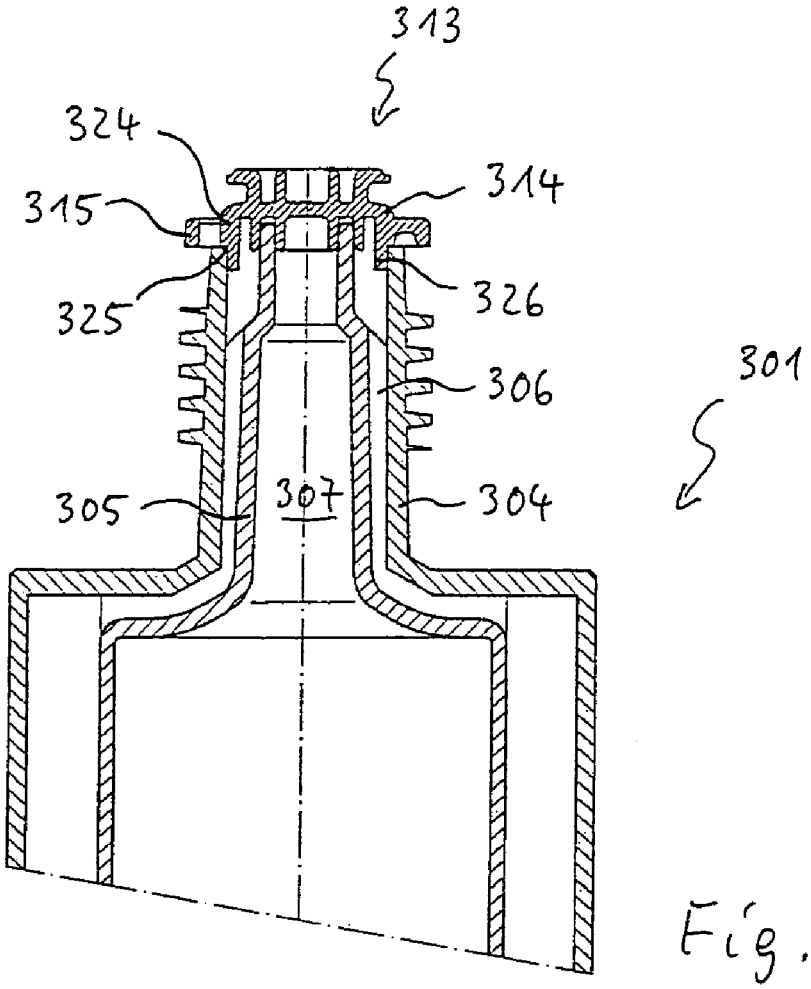
FIG. 9*a*, a section through the cartridge shown in FIG. 8*a* in the reclosed state.
Figure 9B:
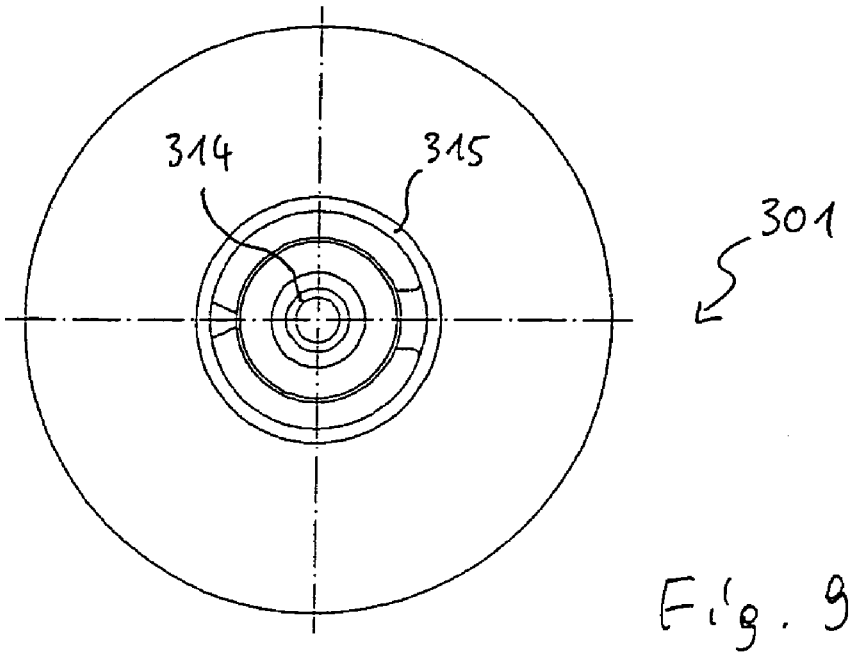
FIG. 9*b*, a top view of the cartridge shown in FIG. 9*a;*

FIGS. 9*a* and 9*b* show a partial cross section and a top view of a cartridge 301 with a fourth embodiment of the seal according to the invention, wherein the cap 314 is reattached to the cartridge 301 because the cartridge contents have not entirely been used up. In this case, the cap in FIGS. 9*a* and 9*b* is turned by 180° relative to FIGS. 8*a* and 8*b*.

FIG. 9*a* shows that, due to the mirror-inverted design of both sides of the cap 314 in its central region, the seal of the inner outlet channel 307 relative to the outer outlet channel 306 initially corresponds entirely to the conditions in the closed original state shown in FIG. 8*a*. The seal of the outer outlet channel 306 relative to the surroundings is not realized with the torn-off predetermined break point 317, but rather the positive engagement between the essentially cylindrical outer surface of the outer edge section 324 of the cap 314, and the also essentially cylindrical inner surface of the outer neck 304 of the cartridge 301. Here, said mating surfaces produce a press fit, and at least one of these surfaces extends conically, preferably the outer surface of the outer edge section 324 of the cap 314.

The shoulder 325 forms a vertical limit stop for the press-in depth of said edge section 324 and consequently the entire cap 314 when the cartridge 301 is reclosed. This means that the non-positive engagement between the edge section 324 and the neck 304 only takes place between the shoulder 325 and the free end of the edge section 324 in the region of the end section 326 with the smaller diameter. It goes without saying that the depth of the structuring of the cap 314 in its radially inner region must be sufficiently large in order to prevent vertical contact between the upper end of the neck 305 and the cap 314, since the shoulder 325 can only act as a vertical limit stop in this case.

The tear-off ring 315 according to FIGS. 8 and 9 advantageously extends around the cap 314 at the height of this cap such that it neither protrudes vertically beyond the cap 314 in the original state shown in FIG. 8*a* nor in the reclosed state of the cartridge 301 shown in FIG. 9*a*. Consequently, the tear-off ring never increases the total length of the cartridge 301. Naturally, a reclosable cap 314 according to the fourth embodiment of the invention inevitably has a larger structural height than the non-reclosable cap 14 in the first embodiment.

Figure 10A:
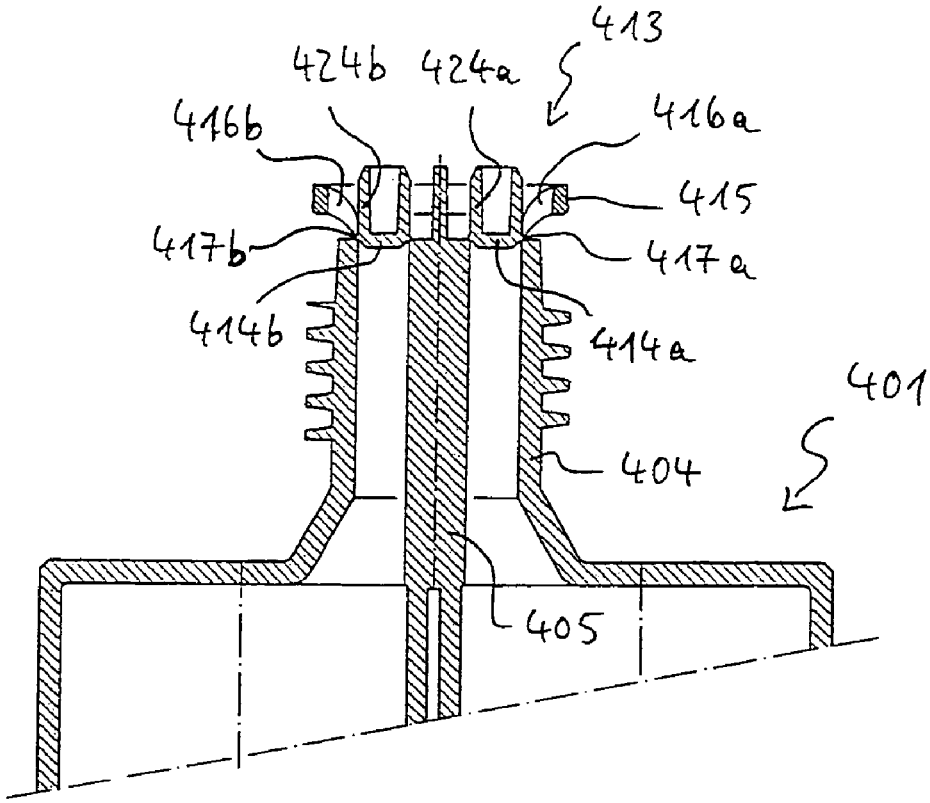
FIG. 10*a*, a section through a side-by-side cartridge with side-by-side outlets and a reclosable tear-off ring seal according to the invention in the unopened state.
Figure 10B:
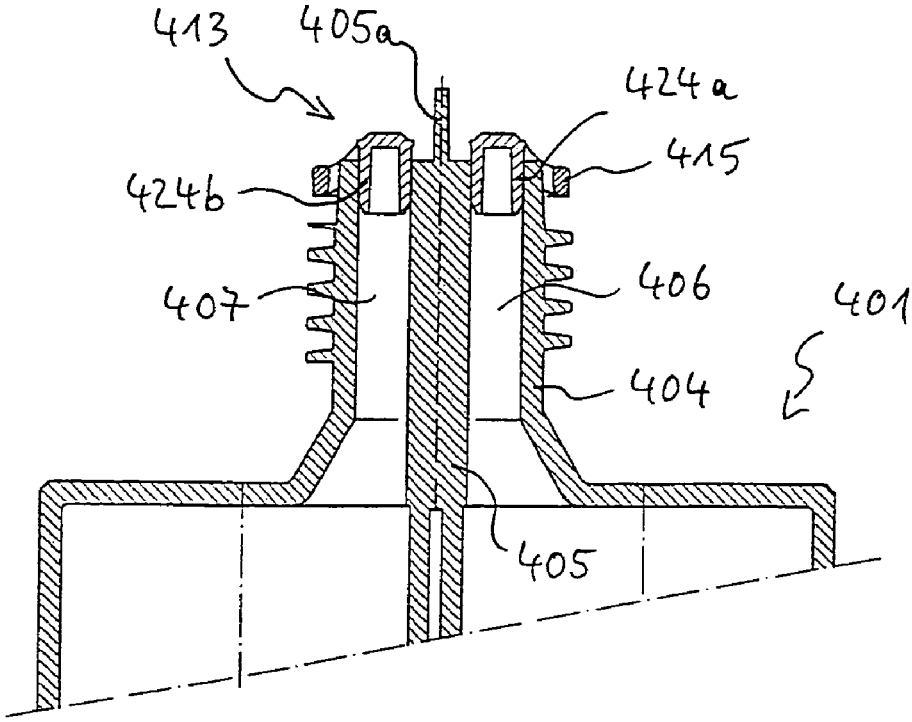
FIG. 10*b*, the cartridge shown in FIG. 10*a* in the reclosed state.

A fifth and final embodiment of the invention is illustrated in FIGS. 10*a* and 10*b*. These figures show a reclosable seal 413 for a side-by-side cartridge 401 with two separate reclosable caps 414*a* and 414*b*. The fifth embodiment differs from the second embodiment shown in FIGS. 4 and 5 in that the upper sides of the caps 414*a* and 414*b* are designed differently. These upper sides are formed in such a way that they are suitable for reclosing the cartridge 401 if its contents have not been entirely used up. In this case, the entire seal 413 must be turned 180° relative to its original state shown in FIG. 10*a* in order to reclose the cartridge 401.

In order to make it possible to reclose the cartridge, essentially cylindrical edge sections 424*a* and 424*b* respectively extend upward from the edges of the caps 414*a* and 414*b* that, in the original state, respectively transition into the neck 404 and the partition wall 405 by means of the predetermined break points 417*a* and 417*b*. Thus, the caps 414*a* and 414*b* respectively have the form of a cup. As in the fourth embodiment shown in FIGS. 8 and 9, the tear-off ring 415 surrounds the seal 413 approximately at the level of the caps 414*a* and 414*b*. In contrast to the second and third embodiments shown in FIGS. 4-7, the connection between the tear-off ring 415 and the caps 414*a* and 414*b* does not begin on the upper side of the caps 414*a* and 414*b* in the form of arc-shaped connecting pieces 416*a* and 416*b*. The transitions from the connecting pieces 416*a* and 416*b* into the caps 414*a* and 414*b* are rather located on the outer side of the edge sections 424*a* and 424*b*, respectively, in specific near the respective predetermined break points 417*a* and 417*b*.

According to FIG. 10*b*, the sealing of the outlet channels 406 and 407 relative to the outside, when reclosing the cartridge, is not achieved by the torn-off predetermined break points 417*a* and 417*b*, but rather the non-positive engagement between the essentially cylindrical outer surfaces of the edge sections 424*a* and 424*b* of the caps 414*a* and 414*b* and the also essentially cylindrical wall surfaces of both outlet channels 406 and 407 that are defined by the neck 404 and the partition wall 405. Here, said mating surfaces respectively produce a press-fit, and at least one of the surfaces that is in contact with the other extends conically, preferably the respective outer surfaces of the edge sections 424*a* and 424*b* of the caps 414*a* and 414*b*.

FIG. 10*b* shows why the connecting pieces 416*a* and 416*b* leading to the tear-off ring 415 must begin near the predetermined break points 417*a* and 417*b*. This is necessary in order to achieve the desired sealing effect by inserting the edge sections 424*a* and 424*b* sufficiently far into the outlet channels 406 and 407 during the reclosing process. In the fifth embodiment, the tear-off ring 415 surrounds the caps 414*a* and 414*b* at approximately the height of the caps such that it neither protrudes vertically beyond the caps 414*a* and 414*b* in the original state shown in FIG. 10*a* nor in the reclosed state of the cartridge 401 shown in FIG. 10*b*. Consequently, the tear-off ring cannot increase the total length of the cartridge 401. Naturally, reclosable caps 414*a* and 414*b* according to the fifth embodiment of the invention inevitably have a greater structural height than the non-reclosable caps 214*a* and 214*b* in the second embodiment. Due to the extension 405*a* of the partition wall 405, this is not important because it does not increase the total length of the cartridge 401.

Figure 11A:
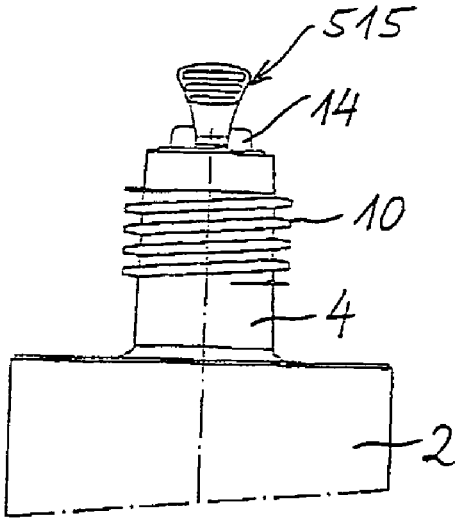
FIG. 11*a*, an external view of the upper region of another embodiment of the cartridge according to the invention.
Figure 11B:
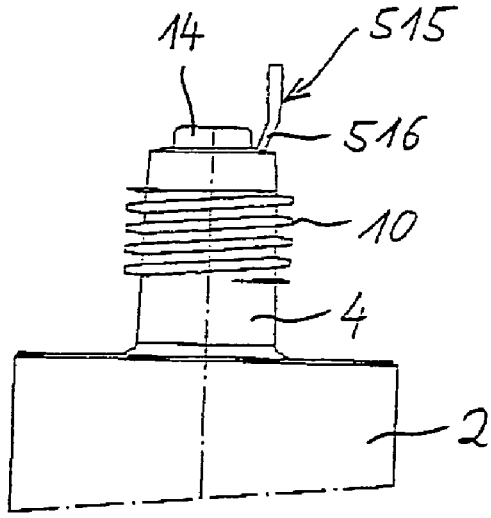
FIG. 11*b*, another external view of the upper region of the cartridge according to the invention shown in FIG. 11*a*, which is turned 90° relative to FIG. 11*a;*
Figure 11C:
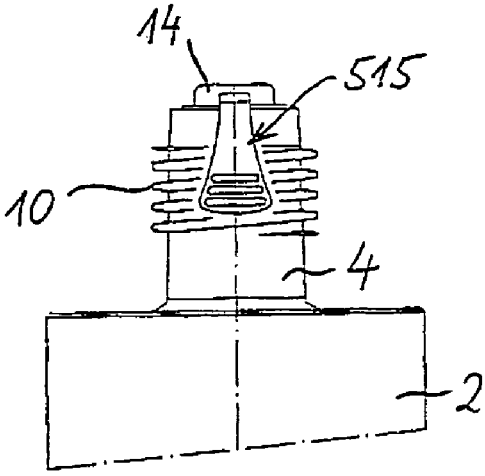
FIG. 11*c*, an outside view of the upper region of another embodiment of the cartridge according to the invention, and FIG. 11*d*, another view of the upper region of the cartridge according to the invention shown in FIG. 11*c* which is turned 90° relative to FIG. 11*c*.
Figure 11D:
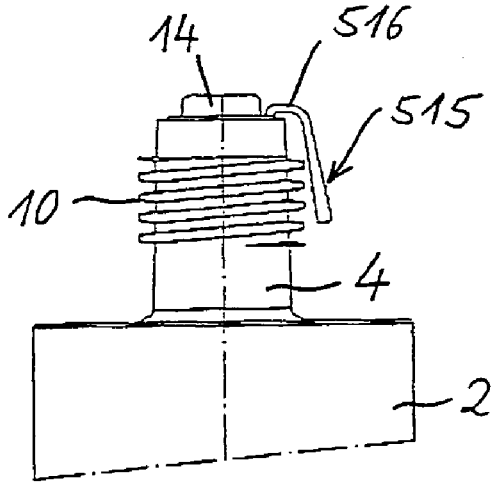

Alternatively to the tear-off ring used in the embodiments of the cartridge shown in FIGS. 1-10, the tear-off element may also consist of a tear-off strap. Such an embodiment of a cartridge according to the invention is illustrated in FIGS. 11*a*-11*d*. Here, the tear-off strap 515 is integrally connected to the cap 14 by means of a flexible connecting element 516. The tear-off strap 515 may be realized and arranged such that it projects beyond the upper edge of the cap 14 as shown in FIGS. 11*a* and 11*b*. Alternatively, the tear-off strap 515 may also be bent downward-as shown in FIGS. 11*c* and 11*d*-such that the tear-off strap 515 does not project beyond the upper end of the cartridge neck including the cap 14.

What is claimed is:

1. A multi-component cartridge comprising:

at least one cartridge neck, integrally formed with a cartridge housing and including at least two outlet openings; and a seal integrally formed with the at least one cartridge neck as a unitary element, the seal including a single cap and a single rear-off element that is integrally formed to the single cap and an outer circumference of the at least two outlet openings, such that the single tear-off element secures the single cap over the at least two outlet openings sealing closed the at least two outlet openings, wherein the single tear-off element includes a predetermined break point such that the single cap can be separated from the cartridge neck by tearing off the single tear-off element along the predetermined break point, wherein the single tear-off element can be manually torn off by exerting tensile force upon the tear-off element by one or more fingers of a hand of a user without the use of any auxiliary means, and wherein the at least two outlet openings can be simultaneously exposed by pulling on the single tear-off element.

2. A multi-component cartridge according to claim 1, wherein the single tear-off element consists of a tear-off ring or of a tear-off strap.

3. A multi-component cartridge according to claim 1, wherein the single tear-off clement is formed with the single cap and the cartridge neck in such a way that the single tear-off element does not significantly project beyond the end of the cartridge including the single cap in the longitudinal direction of the cartridge in order to prevent the connection between the single cap and the cartridge neck from becoming unintentionally torn off.

4. A multi-component cartridge according to claim 1, wherein the single tear-off element is arranged adjacent to the cartridge neck.

5. A multi-component cartridge according to claim 1, wherein the cartridge includes an outer cartridge neck and an inner cartridge neck each having an outlet opening, wherein both outlet openings are arranged coaxially to one another, and wherein the seal seals the outlet opening of the outer cartridge neck relative to the surroundings and the outlet opening of the inner cartridge neck relative to the outlet opening of the outer cartridge neck.

6. A multi-component cartridge according to claim 1, wherein the single tear-off element is realized in the form of a tear-off ring that is arranged in a plane that lies perpendicular to the longitudinal axis of the cartridge.

7. A multi-component cartridge according to claim 6 wherein the tear-off ring is essentially arranged at the level of the single cap.

8. A multi-component cartridge according to claim 1, wherein the cartridge contains two outlet openings that are arranged adjacent to one another and separated from one another by a partition wall, wherein the single cap seals both outlet openings relative to the surroundings due to the fact that the single cap is integrally formed with the cartridge neck as well as to the partition wall.

9. A multi-component cartridge according to claim 8, further comprising a second cap separate from the first cap, wherein each cap respectively seals one of the two outlet openings, and by the fact that both caps are connected to one another by means of a tear-off element.

10. A multi-component cartridge according to claim 1, wherein a sealing element suitable for reclosing the cartridge is provided on an upper side of the single cap that faces an interior of the cartridge.

11. A multi-component cartridge according to claim 1, wherein the cap does not significantly project beyond the upper end of the cartridge neck.

12. A multi-component cartridge according to claim 1, wherein the single tear-off element is connected to the single cap by means of a flexible connecting element.

13. A multi-component cartridge according to claim 12, wherein the flexible connecting element is a flexible connecting piece or a series of flexible connecting pieces.

14. A multi-component cartridge according to claim 13, wherein the tear-off element is a tear-off ring connected to the cartridge neck by at least one additional connecting piece, such that the additional connecting piece includes another predetermined break point that is torn off first when a tensile force is excited on the tear-off ring.

15. A multi-component cartridge according to claim 1, wherein the cartridge, which comprises a cartridge housing, the at least one cartridge neck, the single cap, and the single tear-off element, is manufactured as a single piece of material by means of an injection-molding process.

16. The multi-component cartridge according to claim 15, wherein the single piece of material is a single piece of plastic.

17. The multi-component cartridge according to claim 1, wherein the seal is a hermetic seal of the at least two outlet openings relative to each other and relative to outside of the multi-component cartridge.

18. A multi-component cartridge comprising:

at least one cartridge neck including an outlet opening; and a seal that is integrally connected to the cartridge neck, such that the seal closes the outlet opening, wherein the integral connection of the seal to the cartridge neck includes a predetermined break point such that the cartridge can be opened by tearing off said connection to facilitate the removal of the seal from the cartridge neck, wherein the seal contains at least one cap that is integrally connected to the cartridge neck and at least one tear-off element that is integrally connected to the cap, such that the connection between the cap and the cartridge neck can be manually torn off by exerting tensile force upon the tear-off element, and wherein at least one additional predetermined break point that is intended for being cut off with a cutting tool is provided in addition to the predetermined break points that can be torn off by means of the tear-off element, wherein the cross section of the outlet openings that results from cutting off the additional predetermined break points is larger than the cross section resulting from tearing off the predetermined break points by means of the tear-off ring.

* * * * *